US007281898B2

(12) United States Patent
Baek et al.

(10) Patent No.: US 7,281,898 B2
(45) Date of Patent: Oct. 16, 2007

(54) BLOWING APPARATUS FOR REFRIGERATORS

(75) Inventors: Seung Jo Baek, Kyungki-do (KR); Young Gyu Jung, Inchun-si (KR); Chang Joon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 156 days.

(21) Appl. No.: 11/009,037

(22) Filed: Dec. 13, 2004

(65) Prior Publication Data

US 2005/0152781 A1 Jul. 14, 2005

(30) Foreign Application Priority Data

Dec. 30, 2003 (KR) ..... 10-2003-0100238

(51) Int. Cl.
*F04D 29/28* (2006.01)

(52) U.S. Cl. ..... 416/186 R; 416/223 R; 416/223 B; 415/206

(58) Field of Classification Search ..... 415/206; 416/185, 186 R, 187, 243, 223 R, 223 B
See application file for complete search history.

(56) References Cited

U.S. PATENT DOCUMENTS 3,316,729 A * 5/1967 Mann et al. ..... 62/156
3,766,750 A * 10/1973 Aoh et al. ..... 62/259.1
5,964,576 A * 10/1999 Fujita et al. ..... 415/206
6,042,335 A * 3/2000 Amr ..... 415/208.1
6,299,409 B1 * 10/2001 Matsunaga et al. ..... 415/206
6,558,120 B2 * 5/2003 Kim et al. ..... 416/186 R
6,769,876 B2 * 8/2004 Sakai et al. ..... 416/187

* cited by examiner

*Primary Examiner*—Ninh H. Nguyen
(74) *Attorney, Agent, or Firm*—Birch, Stewart, Kolasch & Birch, LLP

(57) ABSTRACT

Disclosed herein is a blowing apparatus for refrigerators. The blowing apparatus includes a centrifugal fan. The centrifugal fan comprises a hub plate connected to a shaft of the motor, a plurality of blades attached to the hub plate in the radial direction of the hub plate for forcing cool air to flow, and a ring-shaped shroud connected to ends of the blades. The ratio of the inner diameter of the centrifugal fan, formed through connection of the inner ends of the blades, to the outer diameter of the centrifugal fan, formed through connection of the outer ends of the blades, is 0.63±0.01. With the blowing apparatus for refrigerators according to the present invention, flow loss is minimized. Consequently, the present invention has the effect that energy consumption is reduced, noise is decreased, and thus the refrigerator is quietly operated.

6 Claims, 6 Drawing Sheets

BLOWING APPARATUS FOR REFRIGERATORS

BACKGROUND OF THE INVENTION

1. Field of the Invention

The present invention relates to a blowing apparatus that is used to circulate cool air in a refrigerator, and more particularly to a blowing apparatus for refrigerators that is capable of blowing cool air using a centrifugal fan, instead of an axial fan, to reduce flow loss, whereby blowing noise is decreased, and power consumption is reduced.

2. Description of the Related Art

Generally, a refrigerator stores foodstuffs in a fresh state for a long time using cool air obtained by a refrigerating cycle. The cool air is used to cool and prevent decomposition of the foodstuffs.

FIG. 1 is a sectional view showing the inner structure of a refrigerator with a conventional blowing apparatus mounted therein.

As shown in FIG. 1, the refrigerator generally comprises an outer case 1 and an inner case 3. The inner case 3 is partitioned into an upper inner case section and a lower inner case section at a predetermined height. In the upper inner case section is disposed a freezing chamber F, and in the lower inner case section is disposed a refrigerating chamber R. To the fronts of the freezing chamber F and the refrigerating chamber R are pivotably attached doors 5 and 6 for allowing foodstuffs to be put into and taken out of the freezing chamber F and the refrigerating chamber R, respectively.

At the rear of the freezing chamber F is disposed a machinery chamber M, in which an evaporator 7, which constitutes a refrigerating cycle, and a blowing apparatus 10 that circulates cool air generated by means of the evaporator 7 are disposed.

The operation of the refrigerator as described above is as follows: When the blowing apparatus 10 is operated, cool air, cooled by passing through the evaporator 7, is supplied to the freezing chamber F and the refrigerating chamber R via cool air supply channels 8*a* and 8*b*, respectively, and then flows toward the evaporator 7 though a cool air collection channel 9. In this way, the cool air is circulated by means of the blowing apparatus 10 in the refrigerator.

FIG. 2 is a sectional view showing the conventional blowing apparatus mounted in the refrigerator shown in FIG. 1.

As shown in FIG. 2, a channel separation plate 16, which separates the cool air supply channel 8*a* from the machinery chamber M, is disposed in parallel with the inner case 3. At the channel separation plate 16 is formed a cool air introduction hole 17 for allowing the cool air to be introduced from the machinery chamber M to the cool air supply channel 8*a* therethrough.

At the introduction hole 17 is disposed an axial fan 14 that generates a blowing force. The axial fan 14 is rotated by means of a motor 12 mounted in the machinery chamber M.

In the blowing apparatus 10 constructed as described above, the axial fan 14 is rotated as the motor 12 is operated. As a result, cool air having passed through the evaporator 7 is introduced from the machinery chamber M to the cool air supply channel 8*a*. The cool air introduced to the cool air supply channel 8*a* is supplied to the freezing chamber F and the refrigerating chamber R, respectively.

In the conventional blowing apparatus as mentioned above, however, the blowing force is generated by means of the axial fan 14. Consequently, the cool air flows in the axial direction due to the axial fan 14, which increases flow loss. As a result, energy loss is increased, and noise is increased, which is an obstacle to designing more silent refrigerators.

Specifically, the axial fan 14 is disposed at the rear of the inner case 3 defining the cool air supply channel 8*a*. For this reason, when the axial fan 14 is operated, cool air runs against the inner case 3 and is then dispersed in all directions. As a result, flow loss, i.e., energy loss, is increased. Also, an extreme whirlpool phenomenon occurs around the rear of the introduction hole 17 due to flow characteristics of the axial fan 14. Consequently, flow loss is further increased, and noise is further increased.

SUMMARY OF THE INVENTION

Therefore, the present invention has been made in view of the above problems, and it is an object of the present invention to provide a blowing apparatus for refrigerators that is capable of blowing cool air using a centrifugal fan, instead of the conventional axial fan, to minimize flow loss, whereby energy consumption is reduced, noise is decreased, and thus the refrigerator is quietly operated.

In accordance with the present invention, the above and other objects can be accomplished by the provision of a blowing apparatus for refrigerators, including a centrifugal fan, wherein the centrifugal fan comprises: a hub plate connected to a shaft of the motor; a plurality of blades attached to the hub plate in the radial direction of the hub plate for forcing cool air to flow; and a ring-shaped shroud connected to ends of the blades, and wherein the ratio of the inner diameter of the centrifugal fan, formed through connection of the inner ends of the blades, to the outer diameter of the centrifugal fan, formed through connection of the outer ends of the blades, is 0.63±0.01.

Preferably, the inlet angle where each of the blades contacts the tangent line of the inner diameter of the centrifugal fan, formed through connection of the inner ends of the blades, is 32°±1.

Preferably, the outlet angle where each of the blades contacts the tangent line of the outer diameter of the centrifugal fan, formed through connection of the outer ends of the blades, is 41°±1.

Preferably, the solidity, i.e., the ratio of the chord, the shortest distance between the inner end and the outer end of each of the blades, to the pitch, the circumferential distance between the outer end of one blade and the outer end of another adjacent blade, is 0.9±0.1.

The blowing apparatus for refrigerators further comprises: a channel separation plate to separate a cool air flow space into two cool air flow parts, the channel separation plate having a cool air introduction hole, the centrifugal fan being disposed around the cool air introduction hole for discharging the cool air introduced through the cool air introduction hole in the circumferential direction of the centrifugal fan.

Preferably, the channel separation plate is disposed in parallel with an inner case forming an inner wall of a refrigerator for defining a cool air supply channel.

In the blowing apparatus for refrigerators constructed as described above, the centrifugal fan is used instead of the axial fan to supply cool air. Consequently, the present invention has the effect of minimizing flow loss. As a result, energy consumption is reduced, noise is decreased, and thus the refrigerator is quietly operated.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the accompanying drawings.

Figure 1:
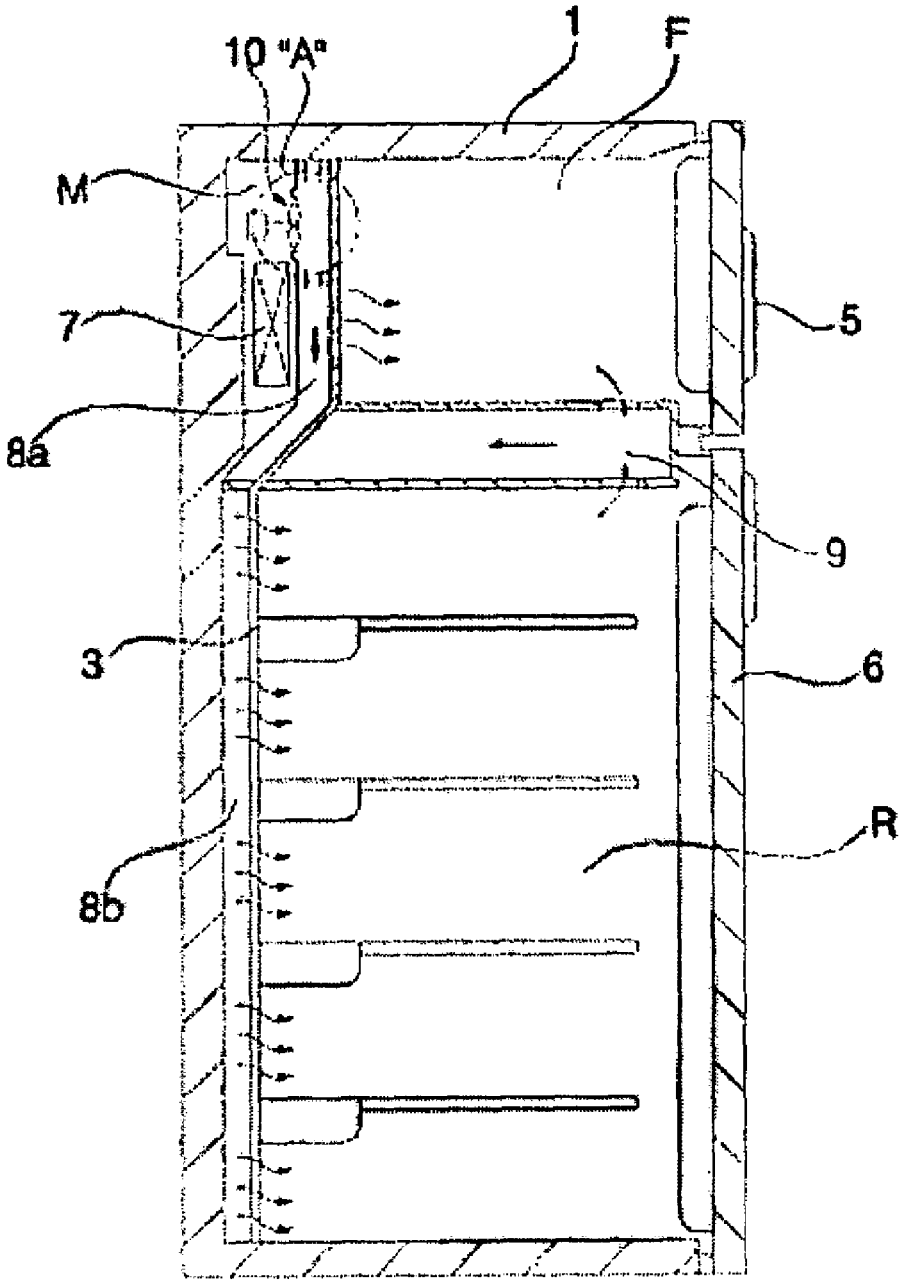
FIG. 1 (Prior Art)
FIG. 1 is a sectional view showing the inner structure of a refrigerator with a conventional blowing apparatus mounted therein.
Figure 2:
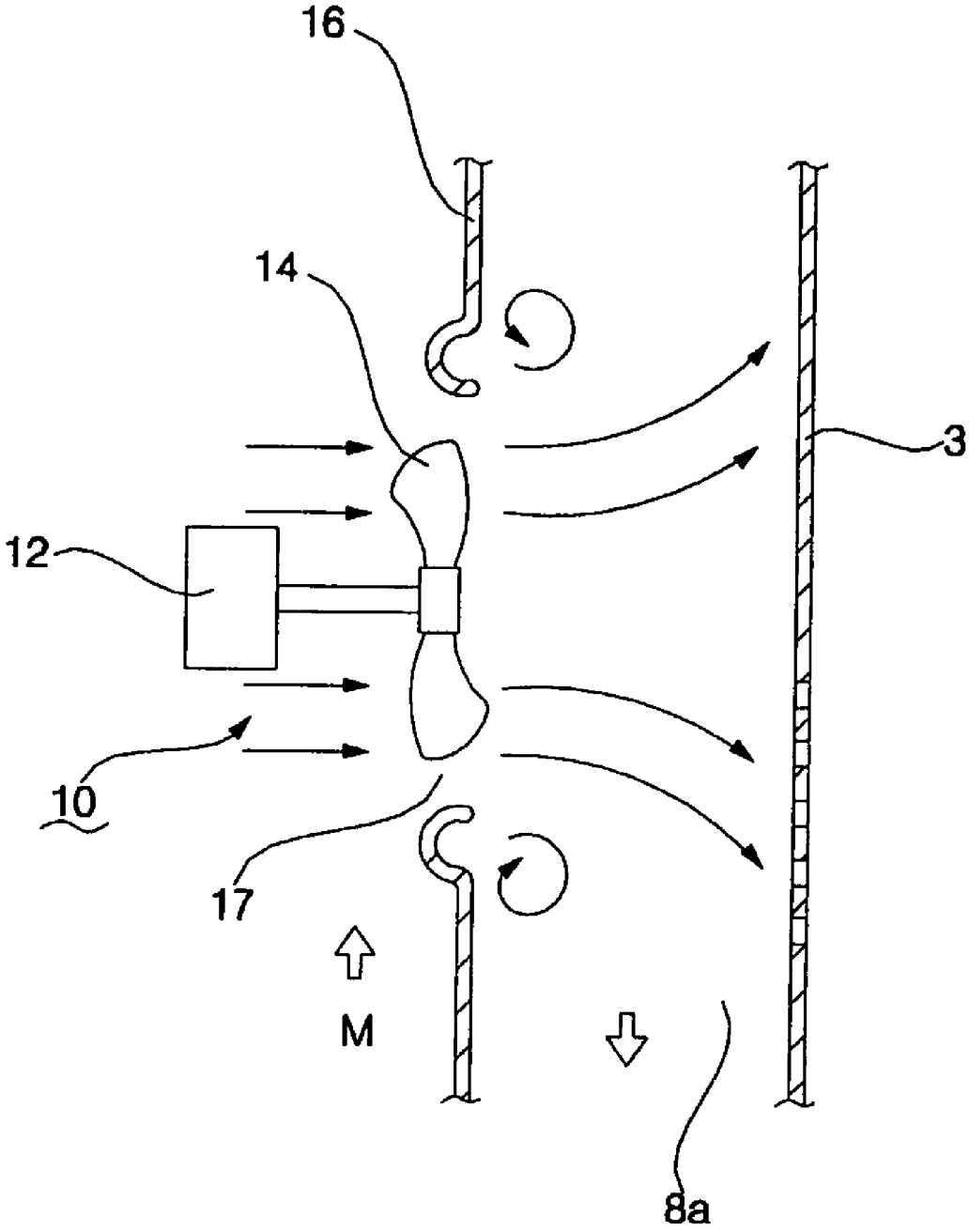
FIG. 2 (Prior Art)
FIG. 2 is a detailed view of part "A" of FIG. 1 showing, in section, the conventional blowing apparatus mounted in the refrigerator.
Figure 3:
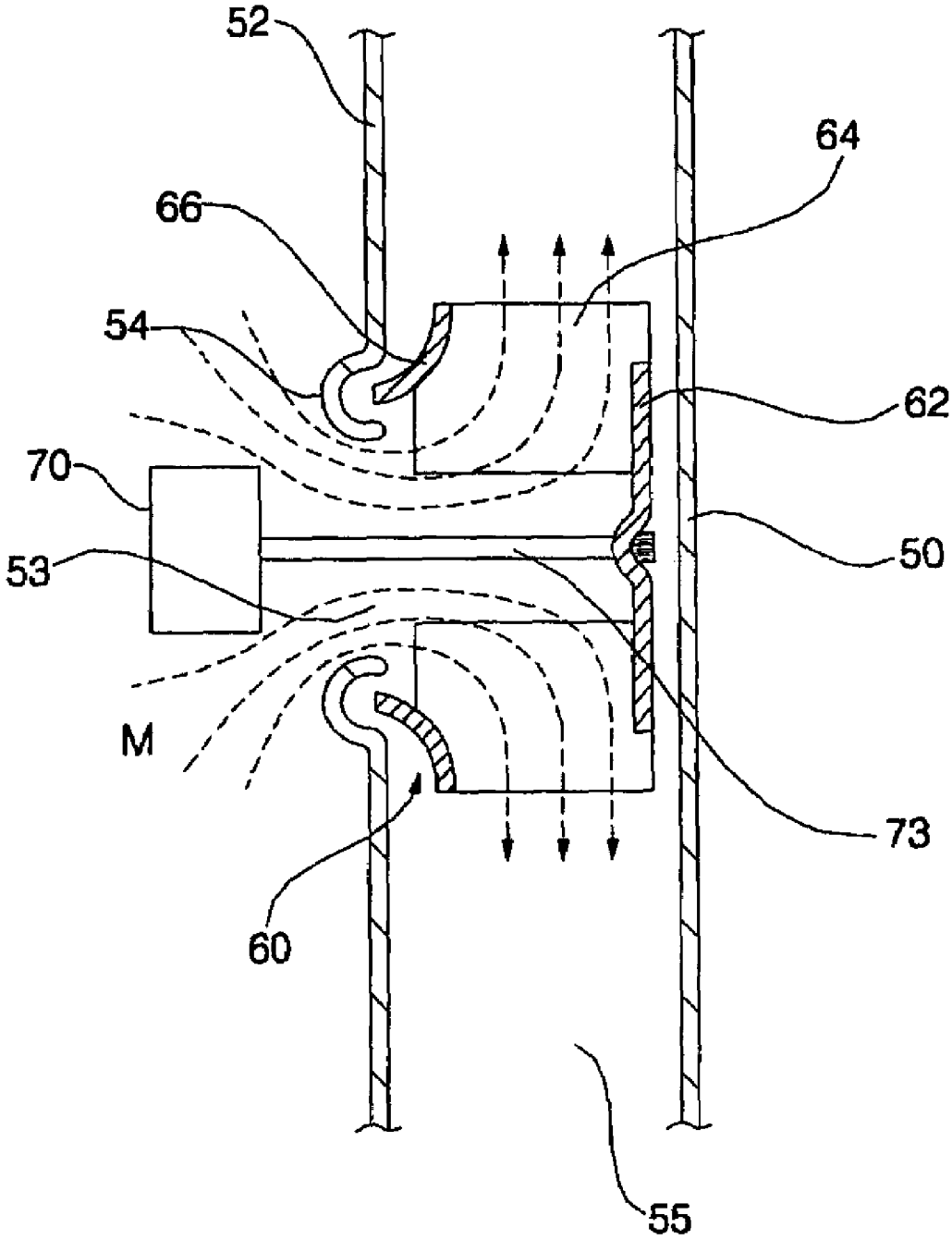
FIG. 3 is a sectional view showing a blowing apparatus according to a preferred embodiment of the present invention mounted in a refrigerator.

FIG. 3 is a sectional view showing a blowing apparatus according to a preferred embodiment of the present invention mounted in a refrigerator.

As shown in FIG. 3, a centrifugal fan 60 is used, instead of the conventional axial fan as described above, according to the present invention.

Specifically, a channel separation plate 52, which separates a cool air supply channel 55 from a machinery chamber M, is disposed in parallel with an inner case 50 of the refrigerator. At the channel separation plate 52 is formed a cool air introduction hole 53 where the centrifugal fan 60 is disposed.

The channel separation plate 52 is provided around the cool air introduction hole 53 with a bell-mouth part 54 having a convex section. Cool air introduced through the cool air introduction hole 53 is more efficiently introduced into the cool air supply channel 55 by means of the bell-mouth part 54. The end of the bell-mouth part 54 is bent toward the centrifugal fan 60.

The centrifugal fan 60 is disposed around the cool air introduction hole 53 for discharging the cool air introduced through the cool air introduction hole 53 along the cool air supply channel 55 in the circumferential direction of the centrifugal fan 60. Specifically, the centrifugal fan 60 is disposed in the cool air supply channel 55 at the rear of the cool air introduction hole 53 in the flow direction of cool air. In the machinery chamber M is mounted a motor 70 that drives the centrifugal fan 60.

Figure 4:
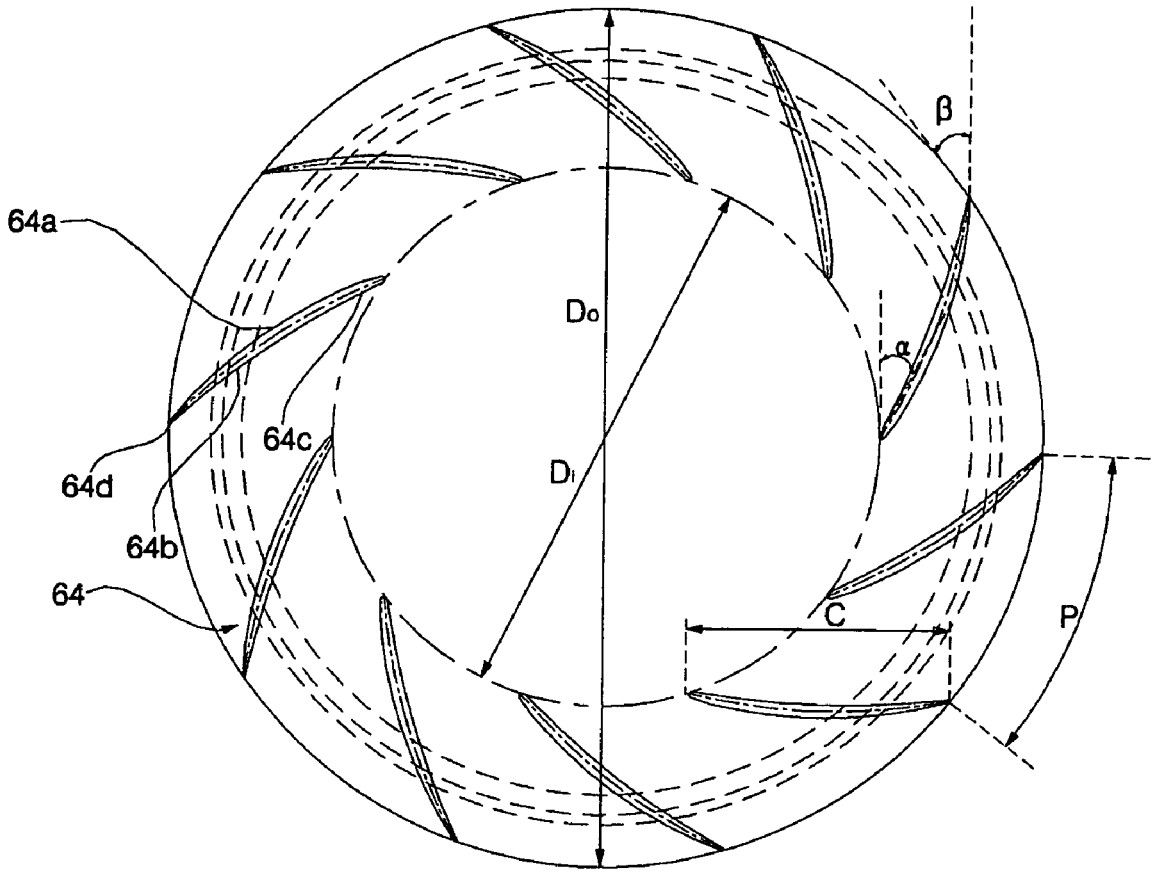
FIG. 4 is a front view showing a centrifugal fan of the blowing apparatus for refrigerators according to the preferred embodiment of the present invention shown in FIG. 3.
Figure 5:
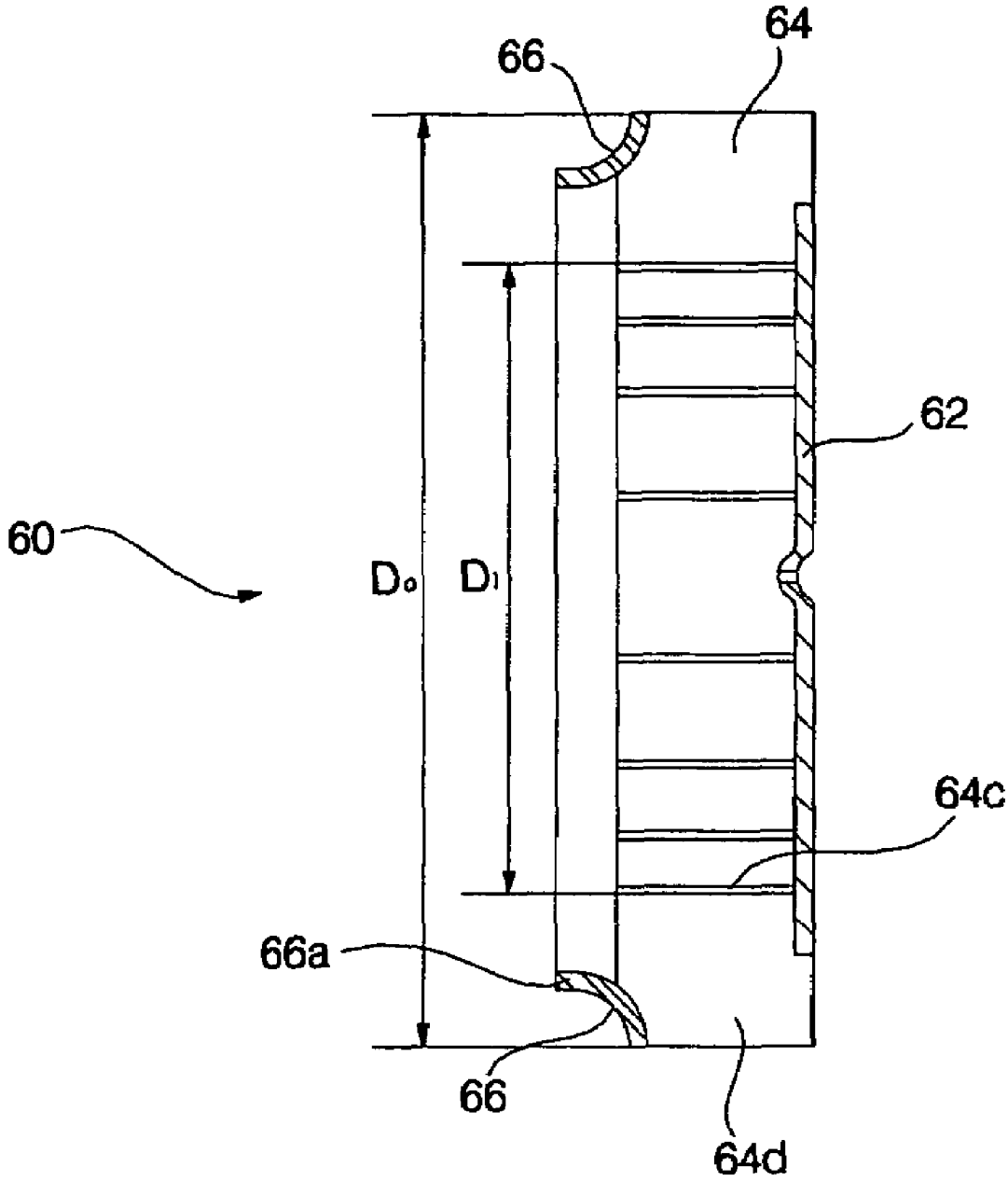
FIG. 5 is a side view, in section, showing the centrifugal fan of the blowing apparatus for refrigerators according to the preferred embodiment of the present invention shown in FIG. 3.

A more detailed description of the centrifugal fan 60 according to the present invention will be given hereinafter with reference to FIGS. 4 and 5. FIG. 4 is a front view showing a centrifugal fan of the blowing apparatus for refrigerators according to the preferred embodiment of the present invention shown in FIG. 3, and FIG. 5 is a side view, in section, showing the centrifugal fan of the blowing apparatus for refrigerators according to the preferred embodiment of the present invention shown in FIG. 3.

The centrifugal fan 60 comprises: a hub plate 62, to which a shaft 73 of the motor 70 is connected (Refer to FIG. 3); a plurality of blades 64 attached to the hub plate 62 in the radial direction of the hub plate 62 for forcing cool air to flow; and a ring-shaped shroud 66 connected to ends of the blades 64.

As shown in FIG. 3, the shaft 73 of the motor 70 is connected to the center part of the hub plate 62. The hub plate 62 is disposed in parallel with the inner case 50.

As shown in FIG. 4, each of the blades 64 comprises: a positive pressure surface 64*a* where cool air is pushed outward; and a negative pressure surface 64*b*, disposed at the rear of the positive pressure surface 64*a*, where pressure below atmospheric pressure is created. Each of the blades 64 further comprises: a front edge part 64*c* contacting the cool air introduced through the cool air introduction hole 53; and a rear edge part 64*d* connected to the front edge part 64*c* in a streamline. The cool air is discharged outward by means of the rear edge parts 62*d*.

The shroud 66 serves to guide the cool air such that the cool air introduced through the cool air introduction hole 53 can be discharged. The shroud 66 is provided with a cool air introduction-side end 66*a*, which is spaced a predetermined distance from the inside of the bell-mouth part 54 such that the cool air introduced through the cool air introduction hole 53 can flow into the cool air supply channel 55 more smoothly.

According to the present invention, the centrifugal fan 60 is designed such that the ratio Di/Do of the inner diameter Di of the centrifugal fan 60, which is formed through connection of the inner ends of the blades 64, to the outer diameter Do of the centrifugal fan 60, which is formed through connection of the outer ends of the blades 64, is 0.63±0.01.

The inlet angle $\alpha$ at which each of the blades 64 contacts the tangent line of the inner diameter Di of the centrifugal fan 60, which is formed through connection of the inner ends of the blades 64, is 32°±1.

The outlet angle $\beta$ at which each of the blades 64 contacts the tangent line of the outer diameter Do of the centrifugal fan 60, which is formed through connection of the outer ends of the blades 64, is 41°±1.

The solidity, i.e., the ratio C/P of the chord C, which is the shortest distance between the inner end and the outer end of each of the blades 64, to the pitch P, which is the circumferential distance between the outer end of one blade 64 and the outer end of another adjacent blade 64, is 0.9±0.1.

Now, the operation and effect of the blowing apparatus for refrigerators with the above-stated construction according to the present invention will be described.

As the motor 70 is operated, cool air having passed through the evaporator (not shown) is forced to flow to the cool air supply channel 55 by means of a blowing force of the centrifugal fan 60. The cool air guided to the cool air supply channel 55 is supplied to the freezing chamber and the refrigerating chamber.

When the cool air is forced to flow by means of the centrifugal fan 60 disposed at the cool air introduction hole 53 of the channel separation plate 52, the cool air introduced into the center part of the centrifugal fan 60 through the cool air introduction hole 53 is discharged in the circumferential direction while passing between the blades 64, and is then introduced into the cool air supply channel 55.

According to the present invention as described above, the cool air flows in the refrigerator while flow loss is minimized, since the centrifugal fan 60 is used instead of the conventional axial fan. Consequently, power consumption is reduced, and noise is decreased.

In order to confirm the above-mentioned effects, experiments were carried out under the following conditions: the ratio Di/Do of the inner diameter Di of the centrifugal fan 60 to the outer diameter Do of the centrifugal fan 60 was 0.63±0.01, the inlet angle $\alpha$ of each of the blades 64 was 32°±1, the outlet angle $\beta$ of each of the blades 64 was 41°±1, and the solidity of each of the blades 64 was 0.9±0.1. Results of the experiments are shown in FIGS. 6 and 7.

Figure 6:
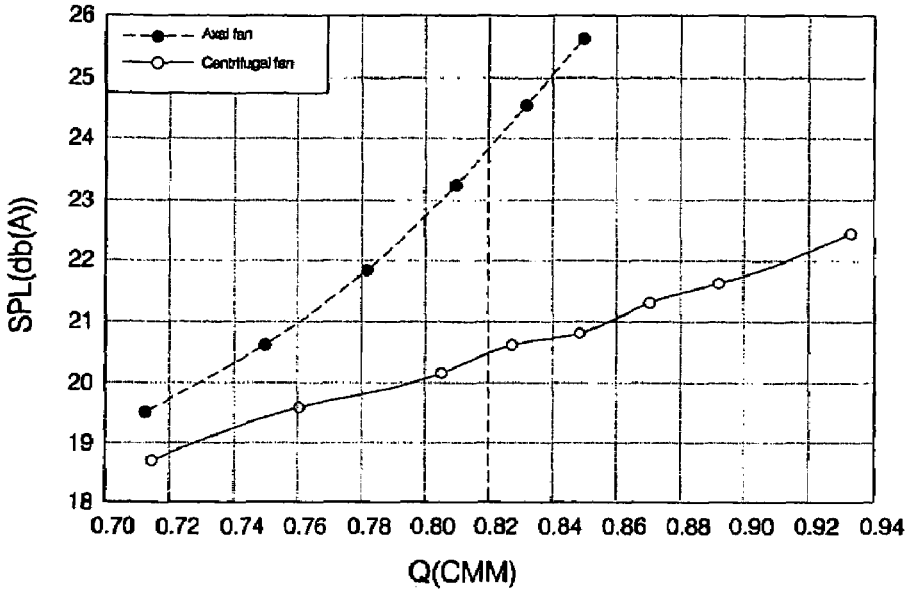
FIG. 6 is a graph illustrating comparison of noise generation between the conventional axial fan and the centrifugal fan according to present invention.
Figure 7:
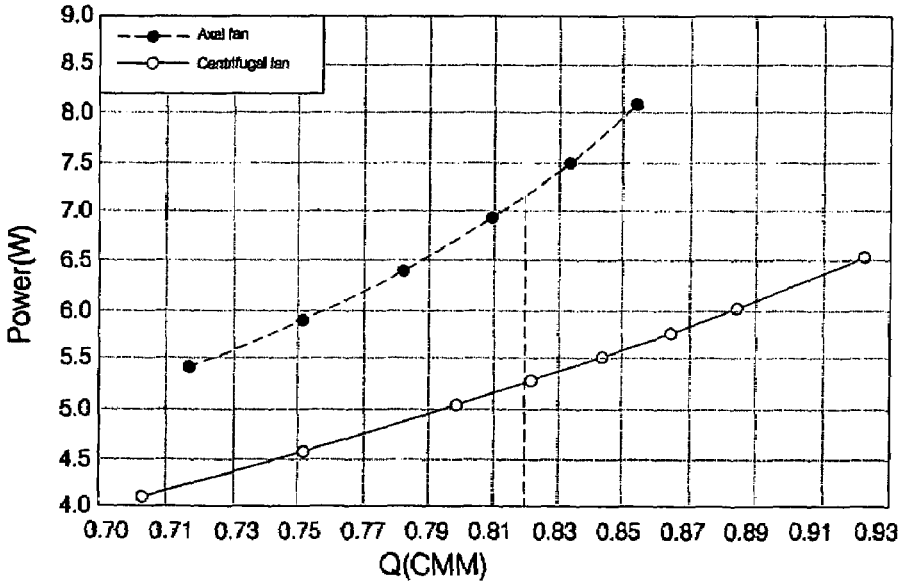
FIG. 7 is a graph illustrating comparison of power consumption between the conventional axial fan and the centrifugal fan according to present invention.

FIG. 6 is a graph illustrating comparison of noise generation between the conventional axial fan and the centrifugal fan according to present invention, and FIG. 7 is a graph illustrating comparison of power consumption between the conventional axial fan and the centrifugal fan according to present invention.

As can be seen from FIGS. 7 and 8, noise generated from the centrifugal fan 60 according to the present invention was 3 dB(A) less than that of the conventional axial fan, and power consumption of the centrifugal fan 60 according to the present invention was 28% less than that of the conventional axial fan, under the condition that the amount of air was 0.82 CMM ($m^3$/min).

As apparent from the above description, the present invention provides a blowing apparatus for refrigerators that is capable of blowing cool air using a centrifugal fan, instead of the conventional axial fan, to minimize flow loss. Consequently, the present invention has the effect that energy consumption is reduced, noise is decreased, and thus the refrigerator is quietly operated.

According to the present invention, power consumption is optimally reduced, and noise is optimally decreased under the conditions that the ratio Di/Do of the inner diameter Di of the centrifugal fan 60 to the outer diameter Do of the centrifugal fan 60 is 0.63±0.01, the inlet angle $\alpha$ of each of the blades 64 is 32°±1, the outlet angle $\beta$ of each of the blades 64 is 41°±1, and the solidity of each of the blades 64 is 0.9±0.1.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A blowing apparatus for refrigerators, including a centrifugal fan, wherein the centrifugal fan comprises:

a hub plate connected to a shaft of a motor;

a plurality of blades attached to the hub plate in the radial direction of the hub plate for forcing cool air to flow; and a ring-shaped shroud connected to ends of the blades, and wherein the ratio of the inner diameter of the centrifugal fan, formed through connection of the inner ends of the blades, to the outer diameter of the centrifugal fan, formed through connection of the outer ends of the blades, is 0.63±0.01, wherein the inner diameters of the centrifugal fan from the shroud side to the hub plate side are constant.

2. The apparatus according to claim 1, wherein the inlet angle where each of the blades contacts the tangent line of the inner diameter of the centrifugal fan, formed though connection of the inner ends of the blades, is 32°±1.

3. The apparatus as set forth in claim 1, wherein the outlet angle where each of the blades contacts the tangent line of the outer diameter of the centrifugal fan, formed through connection of the outer ends of the blades, is 41°±1.

4. The apparatus as set forth in claim 1, wherein the ratio of the chord, the shortest distance between the inner end and the outer end of each of the blades, to the pitch, the circumferential distance between the outer end of one blade and the outer end of another adjacent blade, is 0.9±0.1.

5. The apparatus as set forth in claim 1, further comprising:

a channel separation plate to separate a cool air flow space into two cool air flow parts, the channel separation plate having a cool air introduction hole, wherein the centrifugal fan is disposed around the cool air introduction hole for discharging the cool air introduced through the cool air introduction hole in the circumferential direction of the centrifugal fan.

6. The apparatus as set forth in claim 5, wherein the channel separation plate is disposed in parallel with an inner case forming an inner wall of a refrigerator for defining a cool air supply channel.

* * * * *